United States Patent [19]

Henley et al.

[11] 4,082,867

[45] Apr. 4, 1978

[54] OIL EMULSION REMOVAL AND RECOVERY OF OIL

[75] Inventors: Thomas D. Henley, Broomall; Richard F. Reeves, Roslyn, both of Pa.

[73] Assignee: Amchem Products, Inc., Ambler, Pa.

[21] Appl. No.: 713,806

[22] Filed: Aug. 12, 1976

Related U.S. Application Data

[62] Division of Ser. No. 483,754, Jun. 27, 1974, abandoned.

[51] Int. Cl.[2] ..... C23G 5/00

[52] U.S. Cl. ..... 427/327; 427/239; 134/10; 134/40; 134/28; 260/412.5

[58] Field of Search ..... 134/10, 25 R, 28, 40, 134/3, 25 A, 41, 22 R; 260/412.5, 705; 210/DIG. 5, DIG. 21; 427/327; 252/358; 72/41, 42

[56] References Cited

U.S. PATENT DOCUMENTS

| | | | |
|---|---|---|---|
| 2,711,978 | 6/1955 | Groom | 134/10 |
| 3,025,190 | 3/1962 | Groom et al. | 134/10 |
| 3,450,086 | 6/1969 | Maddock | 134/10 X |
| 3,964,936 | 6/1976 | Das | 148/6.27 |

FOREIGN PATENT DOCUMENTS

| | | | |
|---|---|---|---|
| 2,033,522 | 1/1972 | Germany | 252/358 |

*Primary Examiner*—Ralph S. Kendall
*Attorney, Agent, or Firm*—Alexis Barron

[57] ABSTRACT

Oil emulsion is removed from the surfaces of articles by washing the articles with an aqueous solution of wash water and demulsifier, thereby forming a turbulent mixture of the wash water, the demulsifier and the oil emulsion. The demulsifier is effective in breaking the oil emulsion. The liberated oil is allowed to form a separate phase in the solution of wash water/demulsifier, and is removed therefrom in a quiescent stage. The aqueous solution of wash water and demulsifier having the oil removed therefrom is recycled to wash oil emulsion from other of said articles. The preferred demulsifiers are ammonium and alkali metal sulfates and bisulfates.

20 Claims, 1 Drawing Figure

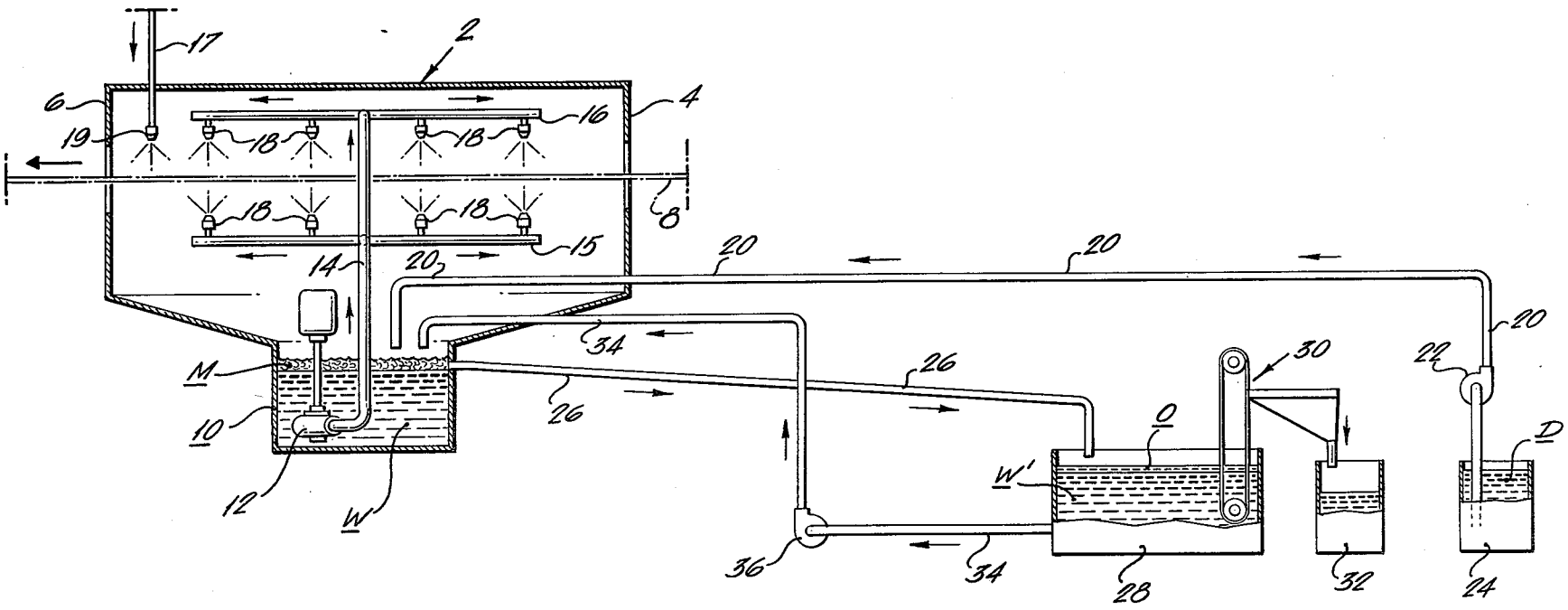
2
4
6
8
10
12
14
15
16
17
18
19
20
22
24
26
28
30
32
34
36
M
O
W
W'

OIL EMULSION REMOVAL AND RECOVERY OF OIL

This is a division of application Ser. No. 483,754, filed June 27, 1974 now abandoned.

This invention relates to the recovery of oils. More specifically, this invention relates to breaking an oil in water emulsion by the use of a demulsifier and recovering the oil for reuse whereby discharging the oil into a sewage treatment system or into the environment is avoided.

The present invention is described in connection with the recovery of oils in a process involving the formation of aluminum cans by the drawing and ironing technique and to the subsequent surface treatment of the cans, including the cleaning and coating thereof. However, it should be appreciated that various principles underlying the present invention can be used in other types of applications where it is desired to recover oils.

Over the past few years, more and more products have been packaged in aluminum cans. And more recently, there has been very wide spread packaging of carbonated drinks and beer, as well as other products, in aluminum cans made by the drawing and wall-ironing technique. (Cans made by this technique are often referred to as "D & I cans".) This wide spread use has led to the development of integrated assembly lines wherein the following process steps are carried out in a continuous operation:

(1) manufacturing the D & I can by drawing and wall-ironing, which includes cooling and lubricating the aluminum surfaces with an oil in water emulsion (hereinafter referred to as an "oil emulsion");

(2) pre-cleaning or pre-washing the cans to remove therefrom the oil emulsion;

(3) cleaning the pre-washed cans by subjecting them to a cleaning solution that is usually acidic, but which may be alkaline, to remove therefrom metal fines which emanate from the drawing and wall-ironing operation and which tend to cling tightly to the surfaces of the cans; and (4) coating the cleaned cans, including sequentially forming thereon a corrosion resistant and paint adherent coating and a decorative coating, such as that comprising a paint, lacquer, or ink finishing; and (5) filling and topping the cans.

The present invention is related to step (2) above and concerns an improved process for removing the oil emulsion from the cans, breaking the oil emulsion, and recovering the oil. It is noted that steps (2) and (3) above are generally carried out in separate stages. The step (3) cleaner, an aqueous solution usually containing a plurality of chemical compounds, is typically recycled and reused for the purpose of realizing economic savings. If step (3) is combined with step (2), the oil emulsion which is removed from the cans tends to make it difficult to effectively recycle the cleaner.

With respect to step (2) above, it has not been uncommon to discharge the oil emulsion which is removed from the cans into a sewage system or directly into the environment. This creates problems because such oil emulsions tend to have adverse effects on sewage treatment processes and on the environment, and the practice can also be in derogation of environmental laws which are designed to discourage and prevent such conduct.

The present invention relates to treating the oil emulsion with a demulsifier, that is, a chemical which breaks the emulsion and liberates the oil, and recovering the oil, preferably in a form so that it is suitable for reuse in various types of applications. Another aspect of the present invention is the use of a selective demulsifier which functions in a manner such that it does not adversely affect subsequent treatment stages of the operation, for example, the cleaning and coating stages.

Reported Developments

It is known that an oil emulsion can be broken by adding thereto an electrolyte, that is, a water soluble compound which dissociates in water and causes the oil to separate by demulsifying action.

Current practice in D & I can manufacture involves passing a portion of the step (3) cleaner, generally acidic, into the wash water/oil emulsion mixture in an attempt to break the oil emulsion. The resulting mixture is discharged as effluent. This results in a loss of said cleaner portion to the discharged effluent and provides no opportunity to separate and recover the oil due to the turbulent condition of the mixture and the stability of the emulsion.

In view of the above, it is an object of this invention to provide an improved method for removing oil emulsion from the surfaces of articles and for recovering the oil of said emulsion.

SUMMARY OF THE INVENTION

The present invention provides a process for removing an oil emulsion from the surfaces of a plurality of articles and for recovering the oil of said emulsion comprising:

(A) removing said oil emulsion from said articles by contacting them with an aqueous solution of wash water and demulsifier thereby providing a turbulent mixture of said wash water, demulsifier and oil emulsion;

(B) collecting said turbulent mixture containing said demulsifier for breaking said oil emulsion to liberate oil therefrom;

(C) allowing said liberated oil to form a separate phase in said wash water and removing said liberated oil of said phase from said wash water in a quiescent stage; and (D) recycling said wash water and demulsifier having said oil removed therefrom by contacting other of said articles with said wash water and demulsifier.

In the case of an aluminum can operation, it is preferred that the oil emulsion be broken by using as the demulsifier one or more of the following: ammonium or alkali metal sulfates or bisulfates, including, for example, the sodium or potassium salts thereof. It has been found that these demulsifiers do not adversely affect subsequent treatment operations of the cans, including the cleaning and the coating thereof with an aqueous coating solution which forms a corrosion resistant and paint adherent coating on the can.

The present invention affords numerous important advantages. The invention can be practiced in such a way that equipment for carrying out the process can be integrated readily into existing can-washing lines. There can be used existing equipment, supplemented by a few pieces of additional equipment for implementing certain of the process steps described herein, which additional equipment can be accommodated nicely in existing spaces of conventional can-forming and treating operations. Also, the process can be carried out in a way whereby the demulsifier and wash water can be recycled to clean additional cans of oil emulsion, thereby providing cost savings for materials. The oil liberated from the emulsion can be in a form satisfactory for permitting it to be reused in various types of applications such as burning as a fuel and reuse as a reconstituted lubricant. And as mentioned above, the use of the sulfate and bisulfate demulsifiers does not adversely affect other steps of the can operation.

BRIEF DESCRIPTION OF THE DRAWING

The FIGURE is a schematic representation of equipment which can be used in the practice of the present invention.

DETAILED DESCRIPTION OF THE INVENTION

The following is a description of the preferred form of the invention. With reference to the FIGURE, there is shown a conventional spray enclosure 2, having openings at sides 4 and 6 for receiving a conveyor 8 carrying inverted aluminum cans (not shown) having their surfaces covered with oil emulsion. A typical oil emulsion contains oil, water, emulsifying agents and other additives known to the art. Wash water W and demulsifier, generally heated, for example, to a temperature of about 110° to about 130° F, is pumped from the bottom of the wash water collection tank 10 by the pump 12 through pipes 14, 15 and 16 which spray the aqueous solution of wash water and demulsifier under pressure (for example, about 15 to about 20 lbs/in$^2$) through nozzles 18 onto the inverted cans. A mixture of the wash water, demulsifier and the washed-off oil emulsion in turbulent condition is collected in the wash water collection tank 10. In a typical operation, 500 to 2,500 cans per minute are processed, each can initially carrying as much as 0.5 g or more of oil emulsion.

There is added into the collection tank 10 through pipe 20 demulsifier D which is pumped by pump 22 from demulsifier container 24, which contains an aqueous solution of the demulsifier. The top portion of the turbulent M mixture in collection tank 10 comprises wash water, demulsifier, oil emulsion and any oil promptly liberated from the emulsion by the action of the demulsifier. The bottom portion of the mixture in tank 10 contains wash water and demulsifier and is substantially free of oil emulsion and oil. The aforementioned top portion of the mixture is allowed to overflow (or it can be pumped) through pipe 26 into oil-separation tank 28. The inflow of the mixture into tank 28 and the tank and attendant apparatus are designed to permit the mixture to reach a quiescent condition, that is, a substantially still condition whereby the oil liberated from the emulsion, due to its having a lower specific gravity than the wash water, is allowed to float to the surface thereof and form an oil layer O thereon. The oil layer O is removed from the oil-separation tank 28 by a conventional rotating belt oil skimmer 30 and is deposited in the oil collection tank 32 which can be stored or removed to a place of use for the oil.

The wash water W′ underlying the oil layer O in the oil-separation tank 28 includes also demulsifier and any other ingredients liberated by the breaking of the oil emulsion such as emulsifying agents. This is transferred through pipe 34 by use of pump 36 to the wash water collection tank 10 from which it is recycled for contact with and washing of other oil emulsion-covered cans.

In preferred form, as shown in the FIGURE, but as an optional form, the aluminum cans are rinsed with water after the oil emulsion has been removed therefrom by spraying with wash water. This is accomplished by spraying rinse water through nozzle 19 fed thereto through pipe 17. This has the advantage that any residual demulsifier adhered to the can is washed off and collected in the wash water collection tank 10 for reuse. This also provides a means for adding to the closed system make-up wash water that may be needed.

It should be appreciated that the invention is applicable to oil emulsion-covered articles other than D & I aluminum cans. For example, the articles may be tinplate or steelplate (blackplate) cans. Other articles such as panels, strips, brackets, etc., made from aluminum or other metal, can be used also.

In general, the oil emulsion presently used in D & I can operations contains hydrocarbon oils such as mineral oils. The present invention is applicable to other oil emulsions. Thus, the oil of the emulsion can be a natural or synthetic oil, for example, fatty oils and fatty acids, including sulfurized forms thereof, and silicon or other synthetic oils. The emulsions are generally made utilizing dispersing or emulsifying agents and can contain, for example, about 1 to about 20 wt. % of oil.

Any compound or mixture of compounds which are effective in breaking oil emulsions can be used in the practice of the present invention. Preferably the demulsifier is an electrolyte that is environmentally acceptable. In addition to the preferred demulsifiers mentioned above, the following are examples of water soluble demulsifiers that can be used: alkali metal phosphates and chlorides. The use of the aforementioned phosphates is particularly desirable in applications wherein the aforementioned stage (3) cleaner is alkaline, such as a phosphate cleaning solution.

The amount of demulsifier needed to break the oil emulsion will depend on many factors such as the particular demulsifier used, the amount of oil in the emulsion, the proportion of oil emulsion present in the wash water, the temperature of the wash water in which the oil emulsion is contained, the particular oil emulsion used, including the particular emulsifying agents in the emulsion, and the time allotted for liberating the oil from the emulsion. Accordingly, the amount used in any particular application should be selected on the basis of experience. For guideline purposes, it is noted that there has been used effectively about 0.5 to about 5 wt. % of the preferred demulsifiers, said weight percent being based on the total weight of the wash water mixture, including the oil emulsion and the demulsifier.

For most applications, the pre-washing of the article to remove therefrom oil emulsion will be followed by cleaning and pre-paint coating operations. These operations precede the application to the coated metal article of a siccative coating, such as that formed from paint, ink or lacquer. The particular type of cleaning solution and pre-paint coating solution used will depend on the type of metal surface being treated and the particular use to be made of the article; they can be selected in accordance with the known state of the art.

One of the more widely used acidic cleaning solutions contains sulfuric acid and other ingredients known to the art. The preferred sulfate and bisulfate demulsifiers mentioned above are ideally suited for use with the sulfuric acid cleaner because they are compatible therewith. Furthermore, they do not adversely affect the metallic surface, and residual deposits of the sulfate or bisulfate demulsifier which may be left on the metallic surface do not react with the sulfuric acid cleaner to form materials which adversely affect the surface. The preferred demulsifiers can be used effectively in a process wherein the wash water is not recycled. However, recycling is preferred as shown in the embodiment described in connection with the FIGURE.

In the preferred embodiment shown in the FIGURE, the quiescent stage in which the oil is removed from the wash water is achieved by transferring the turbulent mixture through a pipe to a separate tank where it is allowed to calm. It should be understood that other means may be provided for obtaining the quiescent stage in which the oil is removed from the wash water. For example, the turbulent mixture of wash water and oil emulsion may be overflowed into a contiguous tank in which it is allowed to calm and from which the liberated oil may be removed.

Also, methods other than skimming the oil film may be used to remove the oil from the wash water. For example, the liberated oil may be absorbed on a material, such as calcium carbonate, which is added to the wash water mixture in the quiescent stage. The oil may also be removed by other mechanical devices such as a centrifuge.

Automatic feed mechanism can also be used to feed demulsifier into the system as needed. For example, it is known that the concentration of an electrolyte in an aqueous solution thereof can be determined by measuring the conductivity thereof. Initially, the desired amount of demulsifier to use in the process is determined. Suitable available equipment for sensing the conductivity of the aqueous solution of wash water and demulsifier can be incorporated into the apparatus comprising the system. As the conductivity of said solution falls below the predetermined desired amount, appropriate commercially available mechanism, integrated with the conductivity sensor, can be used to trigger the feeding of additional demulsifier into the system, thereby maintaining therein the desired amount of demulsifier.

EXAMPLES

Examples below illustrate practice of the present invention.

EXAMPLE NO. 1

This example is described in connection with the FIGURE. D & I aluminum cans were treated in accordance with the invention. The working volumes of wash water collection tank 10 and oil-separation tank 28 were 800 and 150 gallons respectively. There was charged to the system 110 gallons of a 40 wt. % aqueous solution of ammonium sulfate demulsifier, thereby providing a mixture of wash water, oil emulsion and ammonium sulfate, the concentration of which was about 4.6 wt. % based on the total weight of the mixture. The emulsion on the cans was a hydrocarbon oil emulsion produced from a lubricant sold by Mobil Oil Co. under the trademark Prosol 174 and comprised about 14 wt. % oil. The contents of the collection tank 10 were heated to a temperature of about 130° F and were overflowed from the collection tank 10 to the oil-separation tank 28. Aqueous solution of wash water and ammonium sulfate was pumped from the bottom of said tank 28 and recycled to said tank 10. The ammonium sulfate broke the oil emulsion and the liberated oil, which formed a film on the surface of the mixture in tank 28, was removed therefrom by the rotating belt oil skimmer 30.

The operation was run for a total of 10 hours. During this time, there were processed on the average about 250 D & I aluminum cans per minute, having on the average about 0.4 to about 0.6 g of oil emulsion per can. At the end of the 10 hour period, somewhat over 18 gallons of oil that had been liberated from the oil emulsion were collected in the oil collection tank 32. The collected oil was substantially free of water.

It is noted that after about 4 hours of operation, oil stopped adhering to the belt of the skimmer. After flushing the belt with tap water, the belt resumed its excellent oil pick-up. It is postulated that a salt layer had built up on the belt, and that the layer was removed when the belt was flushed with tap water. When the operation was carried out at lower concentrations of ammonium sulfate (1 wt. %), the skimmer operated satisfactorily throughout the operation.

The D & I aluminum cans, after being subjected to the above described pre-wash treatment, were then cleaned with an acidic aqueous sulfuric acid cleaning solution. There were no adverse effects caused by residual demulsifier (ammonium sulfate) on the cans. After the cleaning operation, the cans were coated with a corrosion resistant and paint adherent coating by subjecting them to a commercially available aqueous coating solution. Excellent results were obtained.

In another series of tests, laboratory experiments were conducted to illustrate the use of ammonium sulfate and also a mixture of sodium sulfate and sodium bisulfate in breaking various oil emulsions. In these tests, 20 ml of each of the oil emulsions made from the oils identified in Table 1 below were added to about 130 ml of water, heated to about 130° F, in a beaker. Each of the oil emulsions contained 14 wt. % oil. There was also added to the beaker the demulsifiers identified in Table 1 in the amounts indicated. The amount of oil liberated from each of the emulsions was determined during the various periods of time shown in Table 1. There is set forth in Table 1 the percent of oil liberated after the stated periods of time.

Table 1

| Ex. No. | Oil | Ammonium Sulfate, 2.5 wt. % | Mixture of Na Sulfate and Na Bisulfate, each 1.25 wt. % | % of Oil Liberated after: 20 min. | 40 min. | 60 min. |
|---|---|---|---|---|---|---|
| 2 | Prosol 172 of Mobil Oil Co. | Yes | — | 72.5 | 80.4 | 85.7 |
| 3 | " | — | Yes | 75.0 | 85.7 | 85.7 |
| 4 | Prosol 591 of Mobil Oil Co. | Yes | — | 77.9 | 88.6 | 89.3 |
| 5 | " | — | Yes | 75.0 | 85.7 | 89.3 |
| 6 | Nalco of Nalco Chemical Co. | Yes | — | 101.8 | 178.6 | 117.9 |

Table 1-continued

| Ex. No. | Oil | Ammonium Sulfate, 2.5 wt. % | Mixture of Na Sulfate and Na Bisulfate, each 1.25 wt. % | % of Oil Liberated after: 20 min. | 40 min. | 60 min. |
|---|---|---|---|---|---|---|
| 7 | " | — | Yes | 114.3 | 117.9 | 117.9 |

With respect to Table 1 above, and particularly Example Nos. 6 and 7, it is noted that the percent of oil liberated exceeds 100%. This was due to the separated oil containing water. In effect, the oil-in-water emulsion was broken and there was obtained a water-in-oil emulsion. Thus, although the demulsifiers were effective in liberating the oil, the recovered oil contained some water. The demulsifiers were thus effective, but the recovered oil would not be as suitable for reuse in some applications as oil recovered from the other examples, which oil was substantially free of water. It is believed that substantially water-free oil could not be recovered by heating the water to a temperature somewhat higher than the 130° F temperature used, for example, about 150° F.

In situations where the liberated oil contains an amount of water that may be considered undesirable (for example, like in Example Nos. 6 and 7 above), oil substantially free of water can be recovered by subjecting the water/oil mixture to a higher amount of demulsifier, that is, an amount which is effective in rapidly causing the oil to separate, for example, about 10 to about 30 wt. % of demulsifier. This causes the oil to separate from the water and it can be removed therefrom in a form substantially free of water. The remaining aqueous solution of water and demulsifier can by recycled to the wash water collection tank 10.

In summary, it can be said that the present invention provides a very economical and improved method for washing metallic surfaces of oil emulsion, breaking the oil emulsion and recovering the oil liberated therefrom. The invention provides very practical means for avoiding the discharge of oil into a sewage system treatment and into the environment where it can cause damage.

We claim:

1. A continuous process in which a plurality of moving articles with metallic surfaces having an oil emulsion thereon are first cleaned and then coated comprising:

(A) removing said oil emulsion from said surfaces by contacting them with an aqueous solution consisting essentially of wash water and an oil insoluble demulsifier under conditions which form a turbulent mixture of said wash water, demulsifier and oil emulsion;

(B) collecting said turbulent mixture containing said demulsifier which is effective in breaking said oil emulsion to liberate oil therefrom;

(C) allowing said oil to separate thereby forming a distinct upper oil phase and a distinct lower wash water and demulsifier phase and removing said oil of said upper phase from said wash water and demulsifier of said lower phase in a quiescent stage, whereby oil is recovered;

(D) recycling said wash water and demulsifier having said oil removed therefrom by contacting other of said articles with said wash water and demulsifier; and thereafter (E) applying to said metallic surfaces coating solution which forms thereon coatings to which siccative finishes adhere.

2. A process according to claim 1 wherein said articles are metal cans, and including further cleaning the cans from which said oil emulsion has been removed and forming on the cleaned cans said coating.

3. A process according to claim 2 wherein said metal cans are aluminum cans and wherein said demulsifier is a sulfate or bisulfate of ammonium or an alkali metal or a mixture thereof.

4. A process according to claim 1 wherein additional demulsifier is automatically added to said wash water as needed to maintain the concentration of demulsifier in the wash water at a substantially constant predetermined value.

5. A process according to claim 1 wherein prior to applying said coating, said surfaces are contacted with an alkaline or acidic aqueous cleaning solution.

6. A process according to claim 5 wherein said demulsifier is an ammonium or alkali metal sulfate or bisulfate and wherein said cleaning solution is a sulfuric acid cleaning solution.

7. A process according to claim 6 wherein the amount of oil in said oil emulsion comprises about 1 to about 20 wt. % and wherein the amount of said demulsifier comprises about 0.5 to about 5 wt. % of the total weight of said wash water, oil emulsion and demulsifier.

8. A process according to claim 5 wherein said demulsifier is an alkali metal phosphate and wherein said cleaning solution is an alkaline cleaning solution.

9. A process according to claim 8 wherein the amount of oil in said oil emulsion comprises about 1 to about 20 wt. % and wherein the amount of said demulsifier comprises about 0.5 to about 5 wt. % of the total weight of said wash water, oil emulsion and demulsifier.

10. A process according to claim 8 wherein said alkaline cleaning solution is a phosphate cleaning solution.

11. A process according to claim 10 wherein the amount of oil in said oil emulsion comprises about 1 to about 20 wt. % and wherein the amount of said demulsifier comprises about 0.5 to about 5 wt. % of the total weight of said wash water, oil emulsion and demulsifier.

12. A continuous process in which a plurality of moving articles with metallic surfaces having an oil emulsion thereon are first cleaned and then coated comprising:

(A) removing said oil emulsion from said surfaces by contacting them with a mixture consisting essentially of wash water and an oil insoluble demulsifier for breaking said oil emulsion and liberating oil therefrom under conditions which form a turbulent mixture of said wash water, said demulsifier and said oil emulsion;

(B) collecting said turbulent mixture in which there is formed a top portion containing some of said wash water and said demulsifier, and substantially all of said oil emulsion and any oil which is liberated therefrom, and a bottom portion containing the remainder of said wash water and demulsifier;

(C) transferring said top portion to a quiescent stage, allowing liberated oil to form a separate phase therein and removing said liberated oil of said phase therefrom;

(D) transferring wash water and demulsifier from said quiescent stage to said collected turbulent mixture;

(E) recycling said bottom portion of said collected turbulent mixture by contacting other of said articles therewith; and (F) applying to said surfaces from which the oil emulsion has been removed coating solution which forms thereon a coating to which siccative finishes adhere.

13. A process according to claim 12 wherein said articles are metal cans, and including further cleaning the cans from which said oil emulsion has been removed and forming on the cleaned cans said coating.

14. A process according to claim 13 wherein said metal cans are aluminum cans and wherein said demulsifier is a sulfate or bisulfate of ammonium or an alkali metal or a mixture thereof.

15. A process according to claim 12 wherein said liberated oil forms a film on the surface of said top portion in said quiescent stage and is removed therefrom by skimming.

16. A process according to claim 12 wherein additional demulsifier is automatically added to said wash water as needed to maintain the concentration of demulsifier in the wash water at a substantially constant predetermined value.

17. A continuous process in which a plurality of moving metal cans having thereon oil emulsion containing about 1 to about 20 wt. % oil are first cleaned and then coated comprising:

(A) removing said oil emulsion from said cans by spraying them with a mixture, having a temperature of about 110° to about 130° F, consisting essentially of wash water and a demulsifier for breaking said oil emulsion and liberating oil therefrom under conditions which form a turbulent mixture of said wash water, said demulsifier and said oil emulsion, wherein said demulsifier is selected from the group consisting of ammonium and alkali metal sulfates and bisulfates, and alkali metal phosphates and chlorides, and wherein the amount of said demulsifier comprises about 0.5 to about 5 wt. % of the total weight of said wash water, oil emulsion and demulsifier;

(B) collecting said turbulent mixture in which there is formed a top portion containing some of said wash water and said demulsifier, and substantially all of said oil emulsion and any oil which is liberated therefrom, and a bottom portion containing the remainder of said wash water and demulsifier;

(C) transferring said top portion to a quiescent stage, allowing liberated oil to form a separate phase therein and removing said liberated oil of said phase therefrom;

(D) transferring wash water and demulsifier from said quiescent stage to said collected turbulent mixture;

(E) recycling said bottom portion by contacting other of said articles therewith;

(F) contacting cans from which oil emulsion has been removed with an aqueous cleaning solution; and (G) applying to the cleaned cans coating solution which forms thereon a coating to which siccative finishes adhere.

18. A process according to claim 17 wherein said cleaning solution is an acidic aqueous cleaning solution containing sulfuric acid and wherein said demulsifier is said ammonium or alkali metal sulfate or bisulfate or a mixture thereof.

19. A process according to claim 17 wherein said cleaning solution is an alkaline cleaning solution and wherein said demulsifier is said alkali metal phosphate.

20. A process according to claim 19 wherein said alkaline cleaning solution is a phosphate cleaning solution.

* * * * *